US007757597B2

(12) United States Patent
Lee et al.

(10) Patent No.: US 7,757,597 B2
(45) Date of Patent: Jul. 20, 2010

(54) VARIABLE DISPLACEMENT SWASH PLATE TYPE COMPRESSOR WITH SMOOTH INCLINED MOVING FEATURE

(75) Inventors: Geon-Ho Lee, Seongnam-si (KR); Ik-Seo Park, Incheon (KR); Young-Chang Han, Jeonju-si (KR)

(73) Assignees: DOOWON Technical Collge (KR); DOOWON Electronic Co., Ltd. (KR)

( * ) Notice: Subject to any disclaimer, the term of this patent is extended or adjusted under 35 U.S.C. 154(b) by 413 days.

(21) Appl. No.: 11/792,972

(22) PCT Filed: Sep. 29, 2005

(86) PCT No.: PCT/KR2005/003227

§ 371 (c)(1),
(2), (4) Date: Sep. 25, 2007

(87) PCT Pub. No.: WO2006/085709

PCT Pub. Date: Aug. 17, 2006

(65) Prior Publication Data

US 2008/0028927 A1 Feb. 7, 2008

(30) Foreign Application Priority Data

Dec. 14, 2004 (KR) ..... 10-2004-0105444

(51) Int. Cl.
*F01B 3/00* (2006.01)

(52) U.S. Cl. ..... 92/12.2; 91/505

(58) Field of Classification Search ..... 92/12.2; 91/505; 417/222.2

See application file for complete search history.

(56) References Cited

U.S. PATENT DOCUMENTS

| | | | | | |
|---|---|---|---|---|---|
| 4,973,229 | A * | 11/1990 | Oono et al. | ..... | 92/12.2 |
| 5,980,216 | A * | 11/1999 | Tokumasu | ..... | 92/12.2 |
| 6,139,283 | A * | 10/2000 | Ahn | ..... | 417/222.2 |
| 6,402,481 | B1 * | 6/2002 | Ahn | ..... | 92/12.2 |

FOREIGN PATENT DOCUMENTS

| | | |
|---|---|---|
| JP | 1999-36657 | 12/1999 |
| JP | 13-289159 | 10/2001 |
| KR | 1989-0002548 | 4/1989 |
| KR | 2002-39142 | 5/2002 |
| KR | 2002-39144 | 5/2002 |

* cited by examiner

*Primary Examiner*—Michael Leslie
(74) *Attorney, Agent, or Firm*—Ballard Spahr LLP

(57) ABSTRACT

A variable displacement swash plate type compressor with a smooth inclined moving feature which includes a cylinder block having a plurality of cylinder bores, a front housing disposed at a front end of the cylinder block to form a swash plate chamber, a drive shaft rotatably supported in the cylinder block, a lug plate disposed in the swash plate chamber of the front housing and fixedly installed to the drive shaft, a rear housing disposed at a rear end of the cylinder block and having a suction chamber and a discharge chamber in fluid communication with the cylinder bores through a suction valve and a discharge valve, a swash plate rotated by the lug plate and installed to have a variable inclination angle, a spring supported between the lug plate and the swash plate, and pistons slidably engaged with the swash plate to be reciprocated in the cylinder bores.

14 Claims, 6 Drawing Sheets

[Fig. 1]
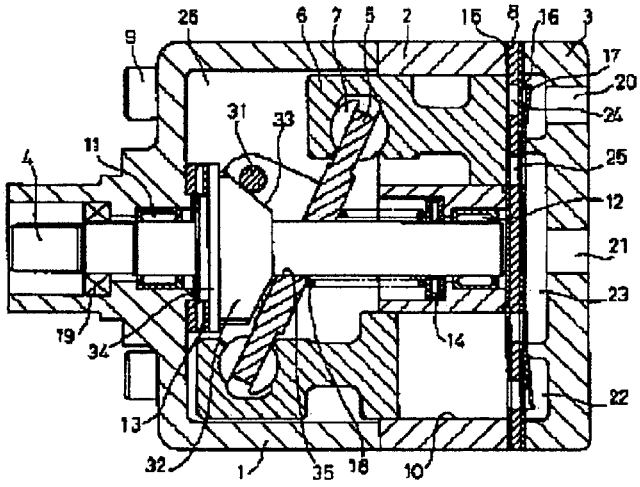
[Fig. 2]
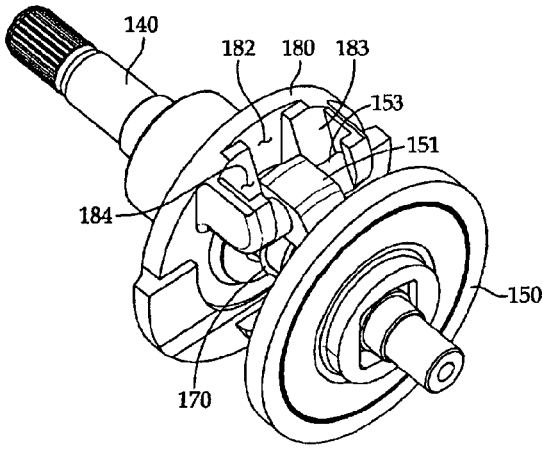
FIG 2-A
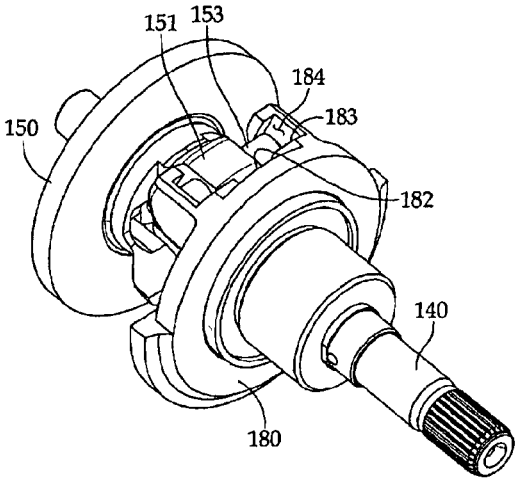
FIG 2-B

[Fig. 3]
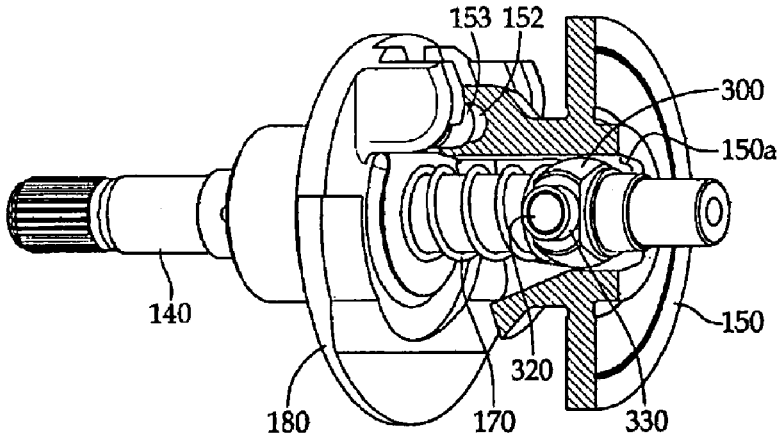
FIG 3-A
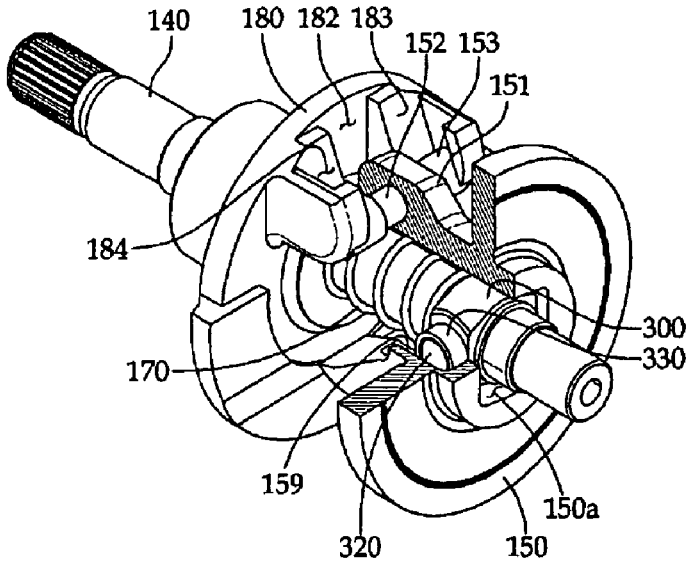
FIG 3-B

[Fig. 4]
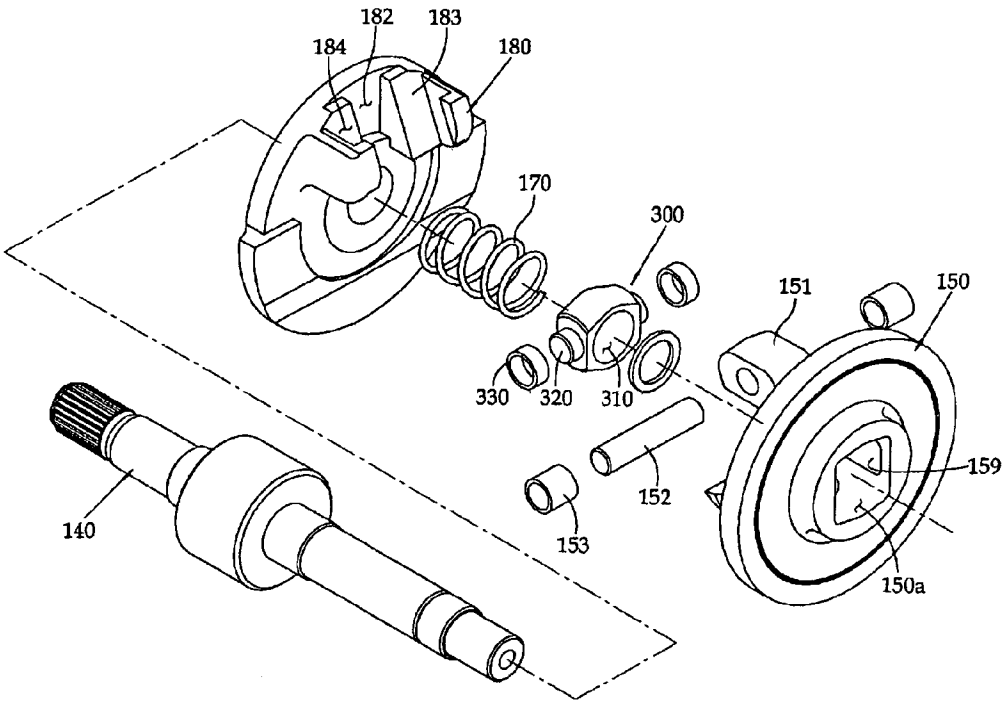
[Fig. 5]
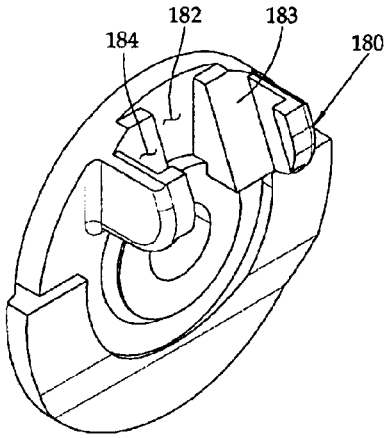

[Fig. 6]
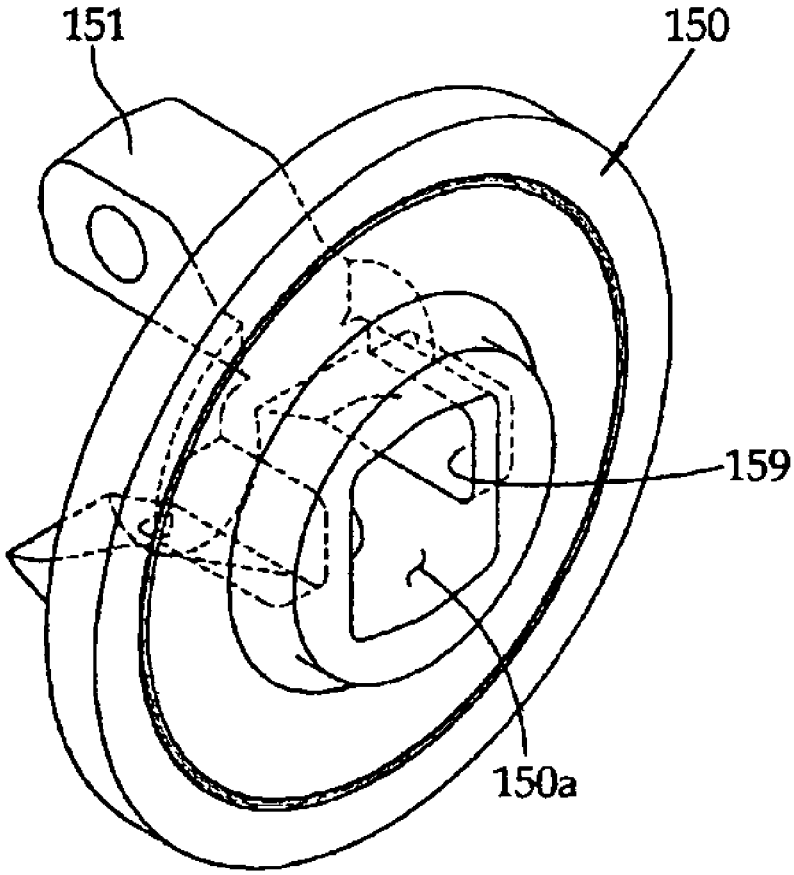

[Fig. 7]
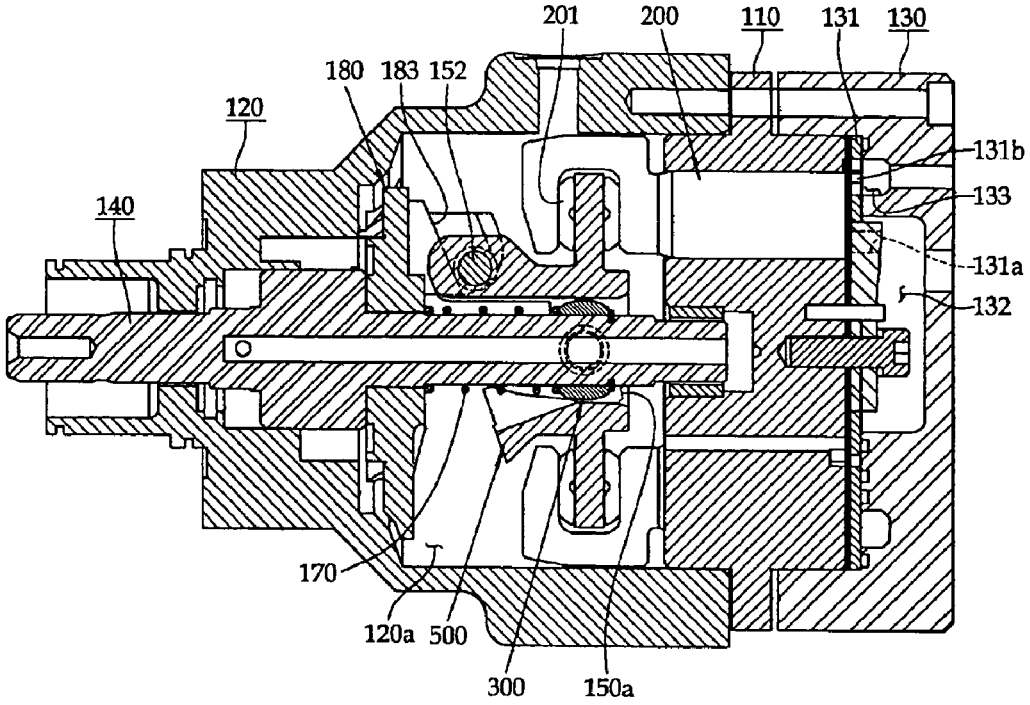
FIG 7-A
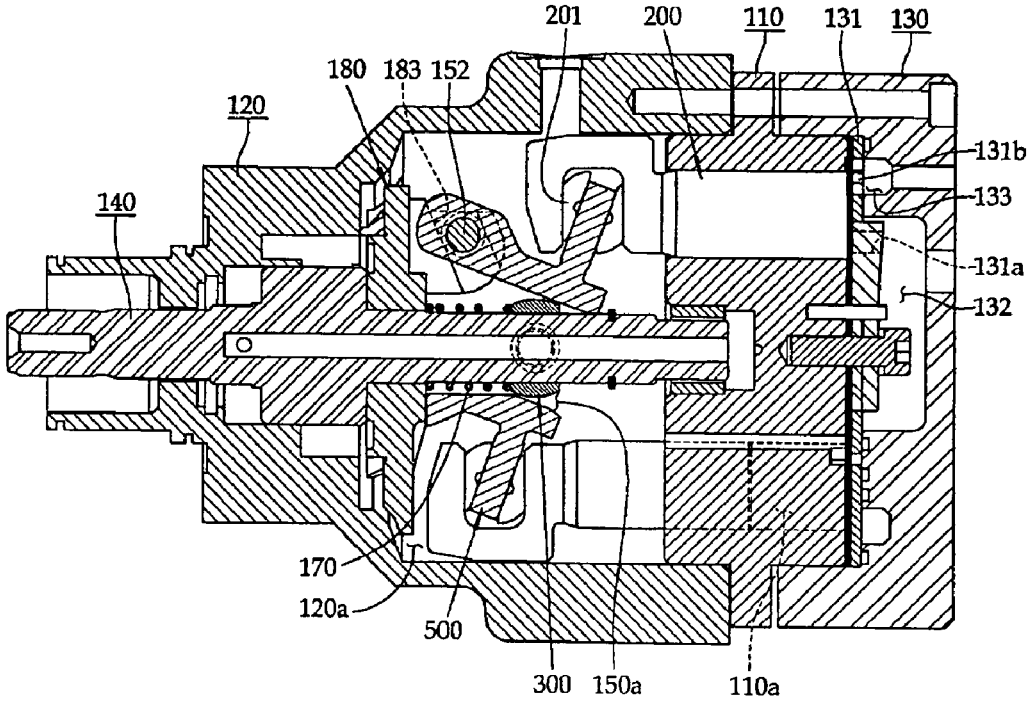
FIG 7-B

[Fig. 8]
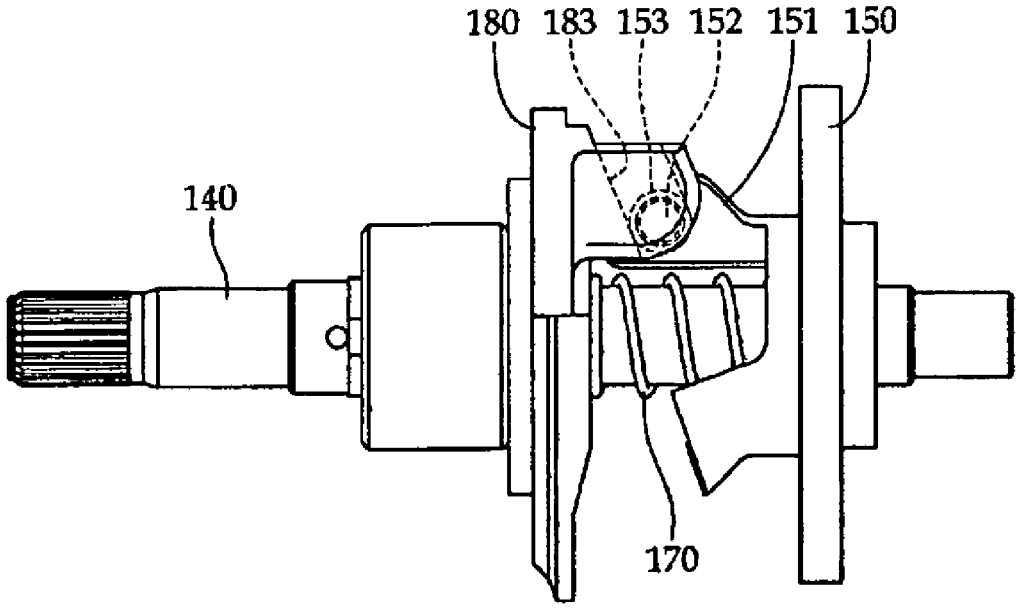
FIG 8-A
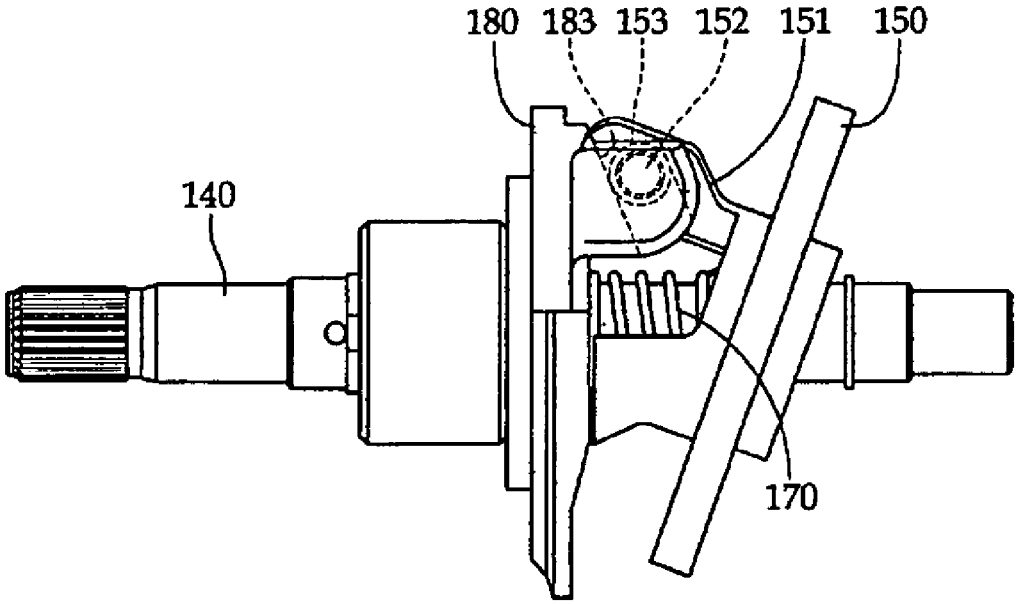
FIG 8-B

VARIABLE DISPLACEMENT SWASH PLATE TYPE COMPRESSOR WITH SMOOTH INCLINED MOVING FEATURE

The present application is a National Phase Application of International Application No. PCT/KR2005/003227, filed Sep. 29, 2005, which claims priority to Korean Patent Application No. 10-2004-0105444 filed Dec. 14, 2004, which applications are incorporated herein fully by this reference.

TECHNICAL FIELD

The present invention relates to a variable displacement swash plate type compressor with a smooth inclined moving feature, and more particularly, to a variable displacement swash plate type compressor having a swash plate capable of smoothly moving in an inclined state without being lifted.

BACKGROUND ART

A conventional swash plate type compressor, which is widely used as a compressor of an air conditioner for an automobile, includes a disk-shaped swash plate having a certain inclination and fixedly installed at a drive shaft for transmitting thee power of an engine by being rotated by the drive shaft, and a plurality of pistons installed around the outer perimeter of the swash plate by interposing shoes between the swash plate and the pistons. By rotation of the swash plate, the pistons are reciprocated in a straight line in a plurality of cylinder bores formed in a cylinder block, thereby sucking, compressing, and discharging refrigerant gas.

Recently, a variable displacement swash plate type compressor has been proposed to provide a more comfortable feeling in an automobile. In the compressor, the inclination of the swash plate is varied according to thermal load to control an amount of refrigerant gas conveyed by the pistons to thereby accomplish precise temperature control, and at the same time, the inclination is continuously changed to attenuate rapid variation in engine torque due to the compressor.

FIG. 1 illustrates a conventional variable displacement swash plate type compressor disclosed in Japanese Patent Laid-open Publication No. 1999-336657, the contents of which will be described hereinafter.

The conventional variable displacement swash plate type compressor includes a cylinder block 2 having a plurality of cylinder bores formed in parallel in a longitudinal direction of an inner peripheral surface thereof, a front housing 1 hermetically sealed in front of the cylinder block 2, and a rear housing 3 hermetically sealed behind the cylinder block 2 by interposing a valve plate 8 therebetween.

A swash plate chamber 26 is formed in the front housing 1, and a drive shaft 4 is disposed through the swash plate chamber 26. For this purpose, one end of the drive shaft 4 is rotatably supported by disposing a bearing 11 at the center of the front housing 1, and the other end of the drive shaft 4 is supported by bearings 12 and 14 in a center hole of the cylinder block 2.

In addition, a swash plate 5 having an inclination angle that varies while moving along a plate section 32 is installed at the drive shaft 4, and a spring 18 is interposed between the center hole of the cylinder block 2 and the swash plate 5 to resiliently support the swash plate 5.

Two plates are installed in parallel with a centerline of the drive shaft 4 at the front surface of the swash plate 5 when the swash plate 5 is disposed perpendicular to the drive shaft 4, and each plate has a circular hole. In addition, a pin 31 is inserted into the circular hole.

In addition, the plate section 32 has a guide surface 33 linearly inclined to the swash plate 5 on its outer surface. When the compressor operates, since the swash plate 5 is inclined, the pin 31 moves along the guide surface 33.

Further, since the plate section 32 is interposed between the plates, the swash plate 5 rotates together with the drive shaft 4.

When the swash plate 5 rotates in an inclined state, the pistons 6 inserted into the periphery surface of the swash plate 5 are reciprocated, through the shoes 7, in the cylinder bores of the cylinder block 2.

In addition, a suction chamber 23 and a discharge chamber 22 are formed at the rear housing 3, and a suction hole 25 and a discharge hole 24 are formed corresponding to the cylinder bores at the valve plate 8 interposed between the rear housing 3 and the cylinder block 2.

A suction lead and a discharge lead are formed at the suction hole 25 and the discharge hole 24 formed at the valve plate 8 to open and close the suction hole 25 and the discharge hole 24 using pressure variation due to the reciprocation of the pistons 6.

As shown in FIG. 1, in the conventional variable displacement swash plate type compressor, the inclination angle of the swash plate 5 is adjusted corresponding to a difference between the pressure in the swash plate chamber 26 and the suction pressure in the cylinder bores so that a stroke of the piston 6 connected to the swash plate 5 varies depending on the inclination angle of the swash plate 5 to vary a discharge capacity of the compressor.

DISCLOSURE OF INVENTION

Technical Problem

However, the conventional variable displacement swash plate type compressor has a structure in which the swash plate is in direct contact with the drive shaft so that it cannot move smoothly on the sloped surface.

In addition, the swash plate is moved on an incline with respect to the drive shaft resulting in severe vibration and noise from the contact surface or even damage of the contact surface.

In addition, the guide pin may be lifted during operation to generate vibration noise and cause ineffectiveness.

Technical Solution

Therefore, the present invention has been made in view of the above-mentioned problems, and it is an object of the present invention to provide a variable displacement swash plate type compressor capable of facilitating inclination movement of a swash plate with respect to the drive shaft and reducing vibration noise to increase durability.

In order to accomplish the above object, there is provided a variable displacement swash plate type compressor comprising a cylinder block having a plurality of cylinder bores, a front housing disposed in a front end of the cylinder block to form a swash plate chamber, a drive shaft rotatably supported in the cylinder block, a lug plate disposed in the swash plate chamber of the front housing and fixedly installed to the drive shaft, a rear housing disposed in a rear end of the cylinder block and having a suction chamber and a discharge chamber in fluid communication with the cylinder bores through a suction valve and a discharge valve, a swash plate rotated by the lug plate and installed to have a variable inclination angle, a spring supported between the lug plate and the swash plate, and pistons slidably engaged with the swash plate to be reciprocated in the cylinder bores, characterized in that a sleeve is movably installed on the drive shaft so as to be movable in the axial direction of the drive shaft and engaged with an inner surface of an insertion hole of the swash plate, and the swash plate is inclinedly and rotatably engaged with the sleeve.

In another aspect of the present invention, there is provided a variable displacement swash plate type compressor comprising a cylinder block having a plurality of cylinder bores, a front housing disposed in a front end of the cylinder block to form a swash plate chamber, a drive shaft rotatably supported in the cylinder block, a lug plate disposed in the swash plate chamber of the front housing and fixedly installed to the drive shaft, a rear housing disposed in a rear end of the cylinder block and having a suction chamber and a discharge chamber in fluid communication with the cylinder bores through a suction valve and a discharge valve, a swash plate rotated by the lug plate and installed to have a variable inclination angle, a spring supported between the lug plate and the swash plate, and pistons slidably engaged with the swash plate to be reciprocated in the cylinder bores, characterized in that a first hooking groove is formed at a rear surface of the lug plate opposite to the swash plate, guide surfaces are inclinedly formed at both sides of the first hooking groove, and second hooking grooves are formed inward along the inclination of the guide surfaces, and a hooking projection is formed at a front surface of the swash plate opposite to the lug plate to be contactably engaged with both side surfaces of the first hooking groove, and a guide pin is projected from both sides of the hooking projection to be relatively moved along the guide surfaces of the lug plate, while contacting with the guide surfaces.

In yet another aspect of the present invention, there is provided a variable displacement swash plate type compressor comprising a cylinder block having a plurality of cylinder bores, a front housing disposed in a front end of the cylinder block to form a swash plate chamber, a drive shaft rotatably supported in the cylinder block, a lug plate disposed in the swash plate chamber of the front housing and fixedly installed to the drive shaft, a rear housing disposed in a rear end of the cylinder block and having a suction chamber and a discharge chamber in fluid communication with the cylinder bores through a suction valve and a discharge valve, a swash plate rotated by the lug plate and installed to have a variable inclination angle, a spring supported between the lug plate and the swash plate, and pistons slidably engaged with the swash plate to be reciprocated in the cylinder bores, characterized in that a sleeve is installed on the drive shaft so as to be movable in the axial direction of the drive shaft and is engaged with an inner surface of an insertion hole of the swash plate, and the swash plate is inclinedly and rotatably engaged with the sleeve, the sleeve has a joint hole through which the drive shaft is movably inserted and guide projections formed at both sides of the joint hole, the swash plate has guide grooves formed at an inner surface of the insertion hole to be engaged with the guide projections of the sleeve such that the guide projections are moved in the axial direction of the drive shaft and stopping steps are formed at the rear end of the guide groove to support the pushed portion of the sleeve.

Preferably, the sleeve has a joint hole through which the drive shaft is movably inserted and guide projections formed at both sides of the joint hole, and the swash plate has guide grooves formed at an inner surface of the insertion hole to be engaged with the guide projections of the sleeve.

Preferably, the guide projection has a cylindrical shape.

At this time, preferably, a hollow cylindrical bearing is rotatably installed around the guide projection.

Preferably, the sleeve has a convex outer surface in contact with the insertion hole of the swash plate.

Preferably, the guide pin has a cylindrical shape.

Preferably, a hollow cylindrical bearing is installed around the guide pin.

Preferably, a stopper is installed on the drive shaft behind the swash plate to maintain a minimum inclination angle.

Preferably, the spring is disposed between a rear surface of the lug plate and a front surface of the sleeve.

BRIEF DESCRIPTION OF THE DRAWINGS

The foregoing and other objects, features and advantages of the present invention will become more apparent from the following detailed description when taken in conjunction with the accompanying drawings in which:

FIG. 1 is a longitudinal cross-sectional view of a conventional variable displacement swash plate type compressor;

FIG. 2A is a front perspective view of a peripheral structure of a swash plate in a variable displacement swash plate type compressor in accordance with the present invention;

FIG. 2B is a rear perspective view of a peripheral structure of a swash plate in a variable displacement swash plate type compressor in accordance with the present invention;

FIGS. 3A and 3B are partially sectional perspective views of FIG. 2A;

FIG. 4 is an exploded perspective view of FIG. 2A;

FIG. 5 is a perspective view of a lug plate of FIG. 4;

FIG. 6 is a perspective view of a swash plate of FIG. 4;

FIG. 7A is a longitudinal cross-sectional view of a variable displacement swash plate type compressor in accordance with the present invention, when a swash plate is in a minimum inclination angle;

FIG. 7B is a longitudinal cross-sectional view of a variable displacement swash plate type compressor in accordance with the present invention, when a swash plate is in a maximum inclination angle;

FIG. 8A is a side view of major components around the swash plate in FIG. 7A; and FIG. 8B is a side view of major components around the swash plate in FIG. 7B.

BEST MODE FOR CARRYING OUT THE INVENTION

Hereinafter, a preferred embodiment of the present invention will be described with reference to accompanying drawings.

FIGS. 2 to 8 illustrate the structure of a variable displacement swash plate type compressor, to which a swash plate can be smoothly moved in an inclined state.

As shown, the variable displacement swash plate type compressor 1000 includes a cylinder block 110 having a plurality of cylinder bores 110*a* formed in parallel in a longitudinal direction on an inner peripheral surface thereof and composing an exterior part of the compressor, a front housing 120 disposed in a front end of the cylinder block 110 to form a swash plate chamber 120*a*, a drive shaft 140 rotatably supported in the cylinder block 110 and the front housing 120, a lug plate 180 disposed in the swash plate chamber 120*a* of the front housing 120 and fixedly installed on the drive shaft 140, a rear housing 130 having a suction chamber 132 and a discharge chamber 133 formed therein and disposed in a rear end of the cylinder block 110, a disk-shaped swash plate 150 rotated by the lug plate 180 so that inclination angle of the swash plate 150 is varied, a spring 170 supported between the lug plate 180 and the swash plate 150, and pistons 200 slidably engaged with the swash plate 150 by shoes 201 and reciprocally received in the cylinder bores 110*a*.

The rear housing 130 has the suction chamber 132 and the discharge chamber 133, and a valve plate 131 has a suction hole 131*a* for communicating the cylinder bores 110*a* and the suction chamber 132 and a discharge hole 131*b* for communicating the cylinder bores 110*a* and the discharge chamber 133.

In addition, a suction valve and a discharge valve are respectively installed in the suction hole 131*a* and the discharge hole 131*b* formed in the valve plate 131 to open and close the suction hole 131*a* and the discharge hole 131*b* using pressure variation due to the reciprocation of the pistons 180.

Other components of the compressor are similar to those of the conventional compressor, so their descriptions will be omitted.

In this embodiment, a sleeve 300 is installed between the drive shaft 140 and an inner surface of an insertion hole 150*a* of the swash plate 150.

The sleeve 300 is movably engaged with the drive shaft 140 in a longitudinal direction thereof. For this purpose, a joint hole 310 is formed in the sleeve 300.

In addition, the sleeve 300 is engaged with the inner surface of the insertion hole 150*a* of the swash plate 150 so as to be movable in the axial direction of the drive shaft 140. Moreover, the swash plate 150 is rotatable in an inclined manner in relative to the sleeve 300. For this, guide projections 320 are installed at both side surfaces of the sleeve 300 about the joint hole 310, and guide grooves 159 are formed at an inner surface of the insertion hole 150*a* of the swash plate 150 such that the guide projections 320 are moved in the lengthwise direction of the drive shaft 140 to be engaged with the guide projections 320 of the sleeve 300.

Stopping steps 159*a* are formed at the rear end of the guide grooves 159 to support a portion of the sleeve 300 pushed by the spring 170.

In the drawings, the guide projections 320 have cylindrical shapes, but not limited thereto, may have oval or polygonal shapes.

When the guide projections 320 have cylindrical shapes, bearings 330 may be installed around the projections so that the swash plate 150 can be more smoothly moved in an inclined manner.

In addition, an outer surface of the sleeve 300, which is in contact with the insertion hole 150*a* of the swash plate 150, has a convex surface to make the swash plate 150 smoothly move in an inclined manner.

Meanwhile, a first hooking groove 182 is formed at a rear surface of the lug plate 180 opposite to the swash plate 150, guide surfaces 183 are inclinedly formed at both sides of the first hooking groove 182, and second hooking grooves 184 are formed inward along the inclination of the guide surfaces 183.

As shown in FIGS. 8A and 8B, when seen from a side view, the guide surfaces 183 are inclined downward from the upside toward the swash plate 150. The second hooking grooves 184 are formed along the guide surfaces 183 from external ends of the guide surfaces 183.

In addition, a hooking projection 151 is formed at a front surface of the swash plate 150 opposite to the lug plate 180 to be engaged with the first hooking groove 182, and a guide pin 152 is projected from both side surfaces of the hooking projection 151 to be relatively movable along the guide surfaces 183 the lug plate 180, while contacting with the guide surfaces 183. The guide pin 152 may be inserted into holes formed in the hooking projection 151 or directly fixed to the hooking projection 151 by welding.

Preferably, the guide pin 152 has an oval or circular cross-section. When the guide pin 152 has a circular cross-section, a hollow cylindrical bearing 153 is installed around the cylindrical guide pin 152 to make the swash plate 150 more smoothly move in an inclined manner.

During operation of the compressor, the first hooking groove 182 of the lug plate 180 and the hooking projection 151 of the swash plate 150 are engaged with each other to transmit rotational force.

In addition, since the second hooking grooves 184 are formed along the inclination of the guide surfaces 183, it is possible to prevent the swash plate 150 from being lifted and to make the swash plate 150 smoothly move in an inclined manner.

Meanwhile, the spring 170 is disposed between the rear surface of the lug plate 180 and the sleeve 300 to allow the sleeve 300 to be in continuous contact with the swash plate 150. Of course, the spring 170 prevents a sudden collision of the swash plate 150 and the lug plate 180.

Hereinafter, operation of the embodiment will be described.

As shown in FIGS. 2 to 8, first, rotational force from an engine (not shown) is transmitted through a pulley (not shown) to rotate the drive shaft 140. As a result, the lug plate 180 for power transmission that is fixed (or press fitted) to the drive shaft 140 is rotated. At the same time, the power is transmitted to the hooking projection 151 engaged with the first hooking groove 182 of the lug plate 180 to rotate the swash plate 150.

Then, the shoe 201 and the piston 200 are reciprocated in the cylinder due to the initial inclination angle of the swash plate 150 so that refrigerant gas is sucked from the suction chamber 132 to be compressed in the bore 110*a* and continuously discharged from the discharge chamber 133. At this time, the capacity of the discharged refrigerant gas is controlled by pressure regulation in the swash plate chamber which is performed by a pressure regulation valve (not shown).

When the pressure in the swash plate chamber 120*a* is decreased, the swash plate 150 is inclined due to a pressure difference between the swash plate chamber 120*a* and the cylinder bore 110*a*, and at the same time, the guide pin 152 of the swash plate 150 can be moved along the guide surfaces 183 and the second hooking grooves 184.

As a result of the operation, a top clearance between a bottom surface of the cylinder bore and the piston is substantially uniformly maintained, and variation of a rotational center point of the swash plate is minimized to optimally maintain volume efficiency of the compressor.

Meanwhile, when the inclination angle is continuously varied to form the maximum inclination angle as shown in FIG. 8B, a lower end of the swash plate is in contact with the lug plate.

In addition, when the drive shaft is not rotated, the swash plate 150 is recovered to the original position (the minimum inclination angle shown in FIG. 8A) by the spring between the swash plate and the lug plate. Here, movement of the swash plate 150 may be restricted by a stopper 144 installed on the drive shaft 140. In addition, using the spring, it is possible to prevent noise due to a collision between the swash plate and the lug plate that is resulted from sudden return of the inclination angle between the swash plate and the lug plate.

INDUSTRIAL APPLICABILITY

As can be seen from the foregoing, since the swash plate is engaged with the drive shaft by the sleeve and the rotational bearing, it is possible to make the swash plate smoothly move in an inclined manner and to reduce vibration noise.

In addition, since the swash plate is engaged with the lug plate by the guide pin and the rotational bearing, it is possible to make the swash plate smoothly move in an inclined manner and to reduce vibration noise.

In addition, since the swash plate is moved along the second hooking groove of the lug plate, it is possible to prevent the swash plate from being lifted or vibrated.

While this invention has been described in connection with what is presently considered to be the most practical and preferred embodiment, it is to be understood that the invention is not limited to the disclosed embodiment and the drawings, but, on the contrary, it is intended to cover various modifications and variations within the spirit and scope of the appended claims.

The invention claimed is:

1. A variable displacement swash plate type compressor comprising a cylinder block having a plurality of cylinder bores, a front housing disposed at a front end of the cylinder block to form a swash plate chamber, a drive shaft rotatably supported in the cylinder block, a lug plate disposed in the swash plate chamber of the front housing and fixedly installed to the drive shaft, a rear housing disposed at a rear end of the cylinder block and having a suction chamber and a discharge chamber in fluid communication with the cylinder bores through a suction valve and a discharge valve, a swash plate rotated by the lug plate and installed to have a variable inclination angle, a spring supported between the lug plate and the swash plate, and pistons slidably engaged with the swash plate to be reciprocated in the cylinder bores, characterized in that a sleeve is installed on the drive shaft so as to be movable in the axial direction of the drive shaft and is engaged with an inner surface of an insertion hole of the swash plate, and the swash plate is inclinedly and rotatably engaged with the sleeve, a first hooking groove is formed at a rear surface of the lug plate opposite to the swash plate, guide surfaces are inclinedly formed at both sides of the first hooking groove, and second hooking grooves are formed inward along the inclination of the guide surfaces, and a hooking projection is formed at a front surface of the swash plate opposite to the lug plate to be contactably engaged with both side surfaces of the first hooking groove, and a guide pin is projected from both sides of the hooking projection to be relatively moved along the guide surfaces of the lug plate, while contacting with the guide surfaces characterized in that the sleeve has a joint hole through which the drive shaft is movably inserted and guide projections formed at both sides of the joint hole, and the swash plate has guide grooves formed at an inner surface of the insertion hole to be engaged with the guide projections of the sleeve.

2. The variable displacement swash plate type compressor according to claim 1, characterized in that the guide projection has a cylindrical shape.

3. The variable displacement swash plate type compressor according to claim 2, characterized in that a hollow cylindrical bearing is rotatably installed around the guide projection.

4. The variable displacement swash plate type compressor according to claim 1, characterized in that the sleeve has a convex outer surface in contact with the insertion hole of the swash plate.

5. The variable displacement swash plate type compressor according to claim 1, characterized in that the guide pin has a cylindrical shape.

6. The variable displacement swash plate type compressor according to claim 5, characterized in that a hollow cylindrical bearing is installed around the guide pin.

7. The variable displacement swash plate type compressor according to claim 1, characterized in that a stopper is installed on the drive shaft behind the swash plate.

8. The variable displacement swash plate type compressor according to claim 1, characterized in that the spring is disposed between a rear surface of the lug plate and a front surface of the sleeve.

9. A variable displacement swash plate type compressor comprising a cylinder block having a plurality of cylinder bores, a front housing disposed at a front end of the cylinder block to form a swash plate chamber, a drive shaft rotatably supported in the cylinder block, a lug plate disposed in the swash plate chamber of the front housing and fixedly installed to the drive shaft, a rear housing disposed at a rear end of the cylinder block and having a suction chamber and a discharge chamber in fluid communication with the cylinder bores through a suction valve and a discharge valve, a swash plate rotated by the lug plate and installed to have a variable inclination angle, a spring supported between the lug plate and the swash plate, and pistons slidably engaged with the swash plate to be reciprocated in the cylinder bores, characterized in that a sleeve is installed on the drive shaft so as to be movable in the axial direction of the drive shaft and is engaged with an inner surface of an insertion hole of the swash plate, and the swash plate is inclinedly and rotatably engaged with the sleeve, the sleeve has a joint hole through which the drive shaft is movably inserted and guide projections formed at both side surfaces of the sleeve about the joint hole, the swash plate has guide grooves formed at an inner surface of the insertion hole to be engaged with the guide projections of the sleeve such that the guide projections are moved in the axial direction of the drive shaft, and stopping steps are formed at the rear end of the guide grooves to support a portion of the sleeve pushed by the spring.

10. The variable displacement swash plate type compressor according to claim 9, characterized in that the guide projection has a cylindrical shape.

11. The variable displacement swash plate type compressor according to claim 10, characterized in that a hollow cylindrical bearing is rotatably installed around the guide projection.

12. The variable displacement swash plate type compressor according to claim 9, characterized in that the sleeve has a convex outer surface in contact with the insertion hole of the swash plate.

13. The variable displacement swash plate type compressor according to claim 9, characterized in that a stopper is installed on the drive shaft behind the swash plate.

14. The variable displacement swash plate type compressor according to claim 9, characterized in that the spring is disposed between a rear surface of the lug plate and a front surface of the sleeve.

* * * * *